US011464280B2

(12) United States Patent
Sung

(10) Patent No.: US 11,464,280 B2
(45) Date of Patent: Oct. 11, 2022

(54) SHOE

(71) Applicant: Ho Dong Sung, Yangju-si (KR)

(72) Inventor: Ho Dong Sung, Yangju-si (KR)

( * ) Notice: Subject to any disclaimer, the term of this patent is extended or adjusted under 35 U.S.C. 154(b) by 182 days.

(21) Appl. No.: 16/612,576

(22) PCT Filed: Feb. 12, 2018

(86) PCT No.: PCT/KR2018/001794

§ 371 (c)(1),
(2) Date: Nov. 11, 2019

(87) PCT Pub. No.: WO2018/216882

PCT Pub. Date: Nov. 29, 2018

(65) Prior Publication Data

US 2020/0359737 A1 Nov. 19, 2020

(30) Foreign Application Priority Data

May 22, 2017 (KR) ..... 10-2017-0063116

(51) Int. Cl.
*A43B 7/32* (2006.01)
*A43B 13/18* (2006.01)

(52) U.S. Cl.
CPC ..... *A43B 7/32* (2013.01); *A43B 13/181* (2013.01)

(58) Field of Classification Search
CPC ..... A43B 13/181; A43B 7/32
See application file for complete search history.

(56) References Cited

U.S. PATENT DOCUMENTS 2,090,881 A * 8/1937 Wilson ..... A43B 13/223 36/29
4,535,553 A * 8/1985 Derderian ..... A43B 13/181 36/28
4,798,010 A * 1/1989 Sugiyama ..... A43B 13/181 36/30 R
5,572,804 A * 11/1996 Skaja ..... A43B 13/20 36/35 B
6,029,962 A * 2/2000 Shorten ..... B29C 66/54 267/145
6,209,226 B1 * 4/2001 Squadroni ..... A43B 7/08 36/141

(Continued)

FOREIGN PATENT DOCUMENTS

CN 1291263 A 4/2001
CN 103750596 A 4/2014

(Continued)

*Primary Examiner* — Jila M Mohandesi
(74) *Attorney, Agent, or Firm* — Novick, Kim & Lee, PLLC; Jae Youn Kim; Jihun Kim

(57) ABSTRACT

The present invention is related to a shoe, the shoe including: a first outsole comprising a bottom portion which contacts the ground, and a plurality of first protruding portions each of which has a dome shape and protrudes upward from the bottom portion, and a second outsole comprising a support portion disposed on the bottom portion, and a plurality of second protruding portions each of which has a dome shape and protrudes downward from the support portion. Protruding end portions of the plurality of second protruding portions are bonded to protruding end portions of the plurality of first protruding portions, respectively.

15 Claims, 11 Drawing Sheets

(56) References Cited

U.S. PATENT DOCUMENTS

| | | | | |
|---|---|---|---|---|
| 7,685,743 | B2 * | 3/2010 | Swigart | A43B 13/181 36/35 R |
| 8,863,408 | B2 * | 10/2014 | Schindler | A43B 13/20 36/29 |
| 2008/0263894 | A1 * | 10/2008 | Nakano | A43B 21/26 36/28 |
| 2009/0056165 | A1 * | 3/2009 | Lee | A43B 13/026 36/88 |
| 2010/0281711 | A1 * | 11/2010 | Vestuti | A43B 21/26 36/28 |
| 2011/0314695 | A1 * | 12/2011 | Tsai | A43B 13/145 36/27 |

FOREIGN PATENT DOCUMENTS

| | | | |
|---|---|---|---|
| CN | 204245304 | U | 4/2015 |
| JP | 3887705 | B2 | 2/2007 |
| KR | 10-2001-0031382 | A | 4/2001 |
| KR | 10-0584527 | B1 | 5/2006 |
| KR | 10-0912646 | B1 | 8/2009 |
| KR | 10-2011-0045439 | A | 5/2011 |
| KR | 2015-0056946 | A | 5/2015 |
| KR | 10-2016-0104023 | A | 9/2016 |
| KR | 10-2016-0128190 | A | 11/2016 |
| WO | 99/22160 | A1 | 5/1999 |

* cited by examiner

SHOE

TECHNICAL FIELD

The present invention relates to shoes, and more particularly, to shoes improved in terms of both shock absorbency and elastic restoring force.

DISCUSSION OF RELATED ART

In general, shoes provide protection for human feet. When people walk or run, shoes protect the feet from the outside environment. When people walk or run, however, a considerable load is applied to the feet. When analyzing the ground repulsive force during running by using a pressure plate, it may be appreciated that the magnitude of the vertical pressure between the ground and the foot is approximately two to three times the weight.

Accordingly, the shoe sole is required to reduce the impact transmitted to the human sole. If the shoe sole does not sufficiently absorb the shock transmitted from the ground while people walk or run, degenerative changes may occur in the joint, or back pain may be caused.

The shoe sole absorbs the shock by using various cushioning members or by lowering the hardness of the shoe sole itself so that the considerable impact applied to the human sole when walking or running is absorbed sufficiently not to put much stress on the skeletal muscle system.

However, the shoe sole requires both the absorbency for shocks that should be reduced when stepping on the ground, and the resilient elasticity that should be increased when raising the foot from the ground. However, as the shoe sole absorbs the shock, the ground repulsive force decreases, so the shock absorbency and the resilient elasticity are mutually incompatible.

Since the conventional shoe sole simply serves the buffering function depending on the shock absorbency of the material, it was difficult to improve the resilient elasticity and durability of the shoe sole when manufacturing the shoe sole using a material having excellent shock absorbency.

Accordingly, in order to improve both the shock absorbency and resilient elasticity, which are mutually incompatible, there are issues that the sole structure of the shoes may become complicated, the weight may increase, and the productivity may be lowered. For example, running shoes may be made by employing an air tube and an injection structure to improve the shock absorbency and resilient elasticity, and in such a case, at least five or six different parts may be employed in the insole, midsole, and outsole, resulting in an increase in weight and causing complication in the manufacturing process.

SUMMARY

Embodiments of the present invention provide shoes improved in terms of shock absorbency, resilient elasticity and grip force and light-weighted as well.

Technical Solution to the Problem

According to an embodiment of the present invention, a shoe includes a first outsole comprising a bottom portion which contacts the ground, and a plurality of first protruding portions each of which has a dome shape and protrudes upward from the bottom portion, and a second outsole comprising a support portion disposed on the bottom portion, and a plurality of second protruding portions each of which has a dome shape and protrudes downward from the support portion. Protruding end portions of the plurality of second protruding portions are bonded to protruding end portions of the plurality of first protruding portions, respectively.

A bottom view of the dome shape of the plurality of first protruding portions and the plurality of second protruding portions may have one or more shape of a circle, an oval, and a polygon with 12 or more sides.

The dome shape of the plurality of first protruding portions and the plurality of second protruding portions may include a lower portion having a bottom view in a polygon shape with 12 or more sides and an upper portion in a hemispherical shape.

Surfaces of the plurality of first protruding portions that face the ground may be open.

Edges of the bottom portion of the first outsole and the support portion of the second outsole may be spaced apart from each other so that side surfaces of the plurality of first protruding portions and the plurality of second protruding portions are exposed to the outside.

The plurality of first protruding portions may be spaced apart from each other with a predetermined empty space therebetween, and the plurality of second protruding portions may be spaced apart from each other with a predetermined empty space therebetween.

The shoe may further include a reinforcing member provided at one or more positions between the plurality of first protruding portions and the plurality of second protruding portions.

The reinforcing member may be made of a material having a hardness different from a hardness of the plurality of first protruding portions and the plurality of second protruding portions.

An edge of the bottom portion of the first outsole and an edge of the support portion of the second outsole may be partially or entirely bonded to each other.

The shoe may include a midsole provided on the second outsole, coupled to a front-end portion and a back-end portion of the first outsole, and coupled to an intermediate portion of the second outsole.

The shoe may include a midsole-coupling locking projection formed extending from one of the midsole and the first outsole, and a midsole-coupling locking hole which is defined in the other of the midsole and the first outsole and through which the midsole-coupling locking projection is inserted.

The first protruding portion and the second protruding portion may be bonded to each other in a high frequency bonding method.

The first protruding portion and the second protruding portion may be made of thermoplastic vulcanizate (TPV).

The shoe may include an outsole-coupling locking projection formed extending from one of the first protruding portion and the second protruding portion, and an outsole-coupling locking hole which is defined in the other of the first protruding portion and the second protruding portion and through which the outsole-coupling locking projection is inserted.

Effects of the Invention

According to embodiments of the present invention, the shoes may be improved in terms of shock absorbency, resilient elasticity and grip force and may be light-weighted as well.

In addition, according to embodiments of the present invention, the shoes may effectively prevent the wearer's ankle from being sprained.

DETAILED DESCRIPTION

Figure 1:
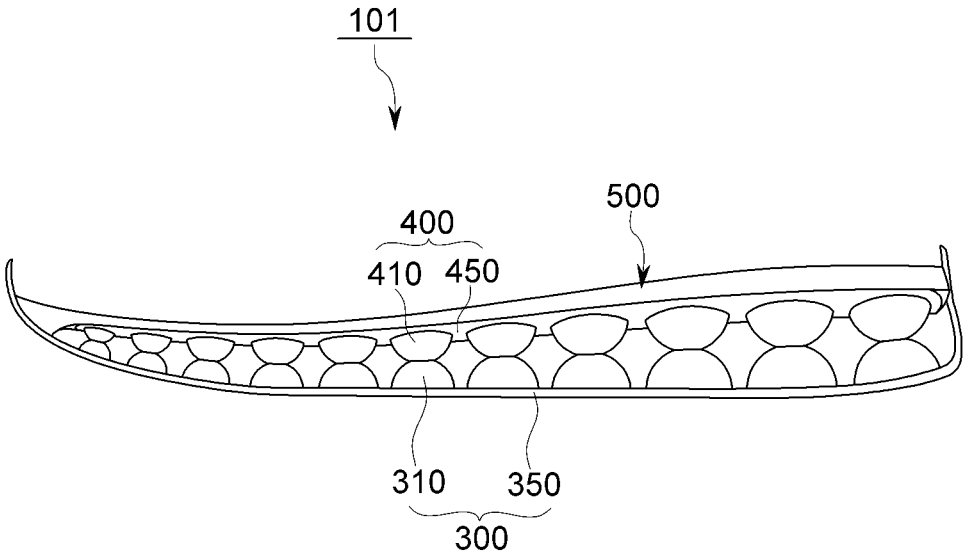
FIG. 1 is a front view illustrating an outsole and a midsole of a shoe according to the first embodiment of the present invention.

Hereinafter, embodiments of the present invention will be described specifically with reference to the accompanying drawings so that those skilled in the art may easily implement the present invention. The present invention may be implemented in various ways and is not limited to the embodiments described herein.

In addition, in various embodiments, components having the same configuration will be representatively described in the first embodiment using the same reference numerals, and in other embodiments, only the configuration different from the first embodiment will be described.

It is noted that the figures are schematic and not drawn to scale. The relative dimensions and ratios of the parts in the figures are exaggerated or reduced in size for clarity and convenience and any dimensions are merely exemplary and not limiting. The same reference numerals are used to refer to similar features in the same structure, element, or part illustrated in more than one figure.

Embodiments of the present invention specifically illustrate desired embodiments of the invention. Accordingly, various modifications of the drawings are expected. Thus, the embodiment is not limited to the specific form of the illustrated region, but includes, for example, modification of the form by manufacture.

Hereinafter, a shoe 101 according to the first embodiment of the present invention will be described with reference to FIGS. 1 to 3.

In addition, for convenience of description, the shoe 101 will be described herein except for an upper part. The upper part may be made of various materials into various shapes, known to those skilled in the art, and may be coupled with a midsole 500 to be described below in various ways.

Figure 2:
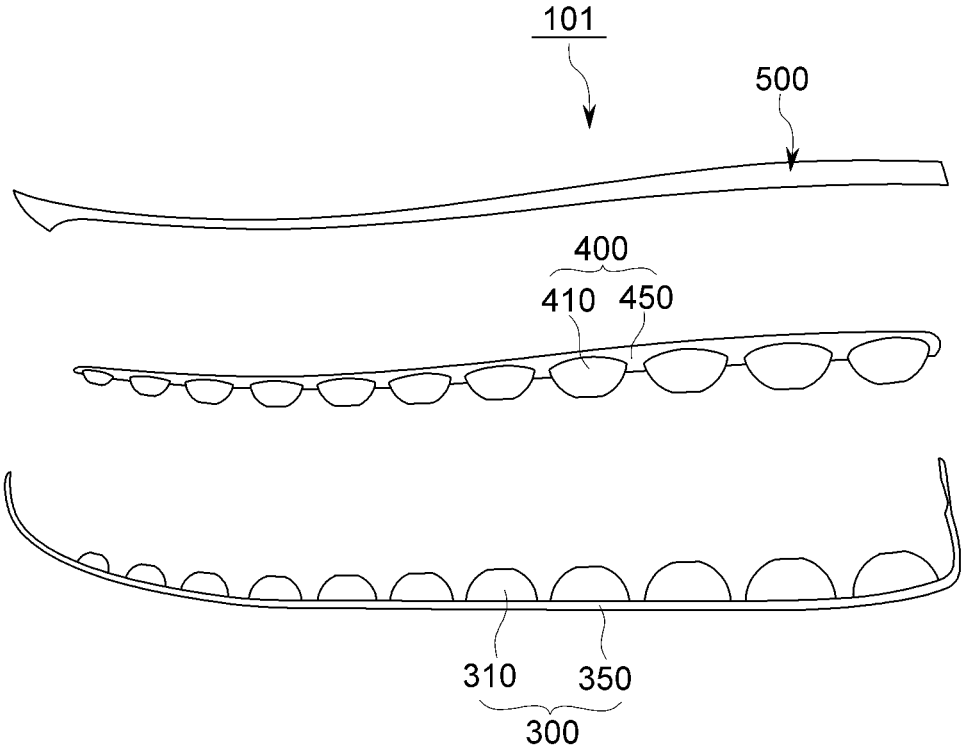
FIG. 2 is an exploded view illustrating the outsole and the midsole of FIG. 1.
Figure 3:
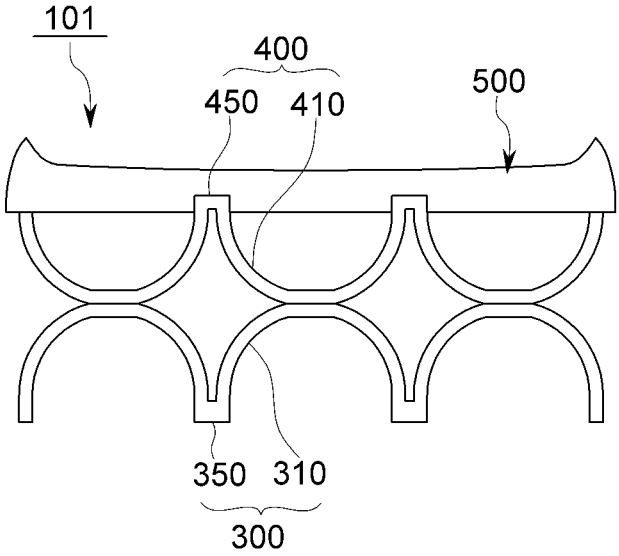
FIG. 3 is a cross-sectional view illustrating the outsole and the midsole of the shoe of FIG. 1.
Figure 4:
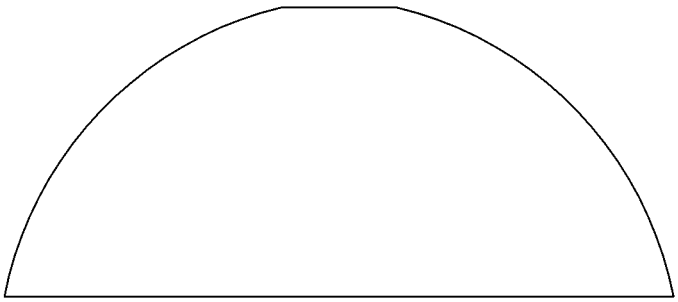
FIGS. 4 to 9 are front and plan views illustrating shapes of a first protruding portion and a second protruding portion according to modifications of the first embodiment of the present invention.
Figure 5:
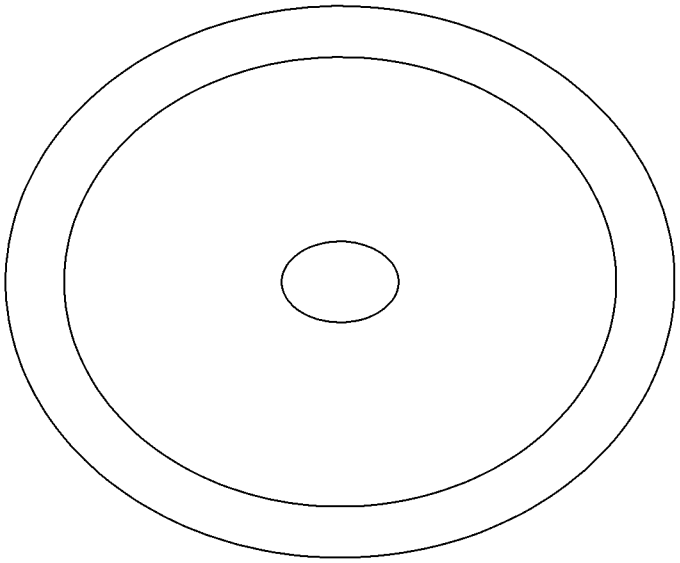
Figure 6:
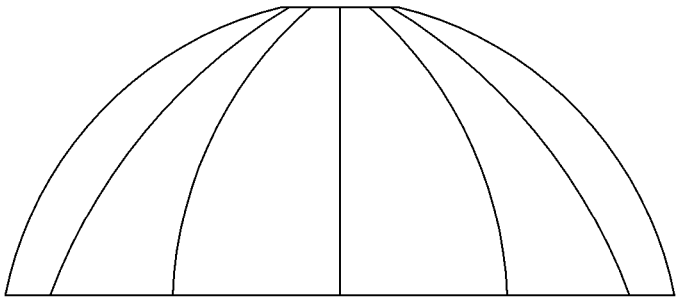
Figure 7:
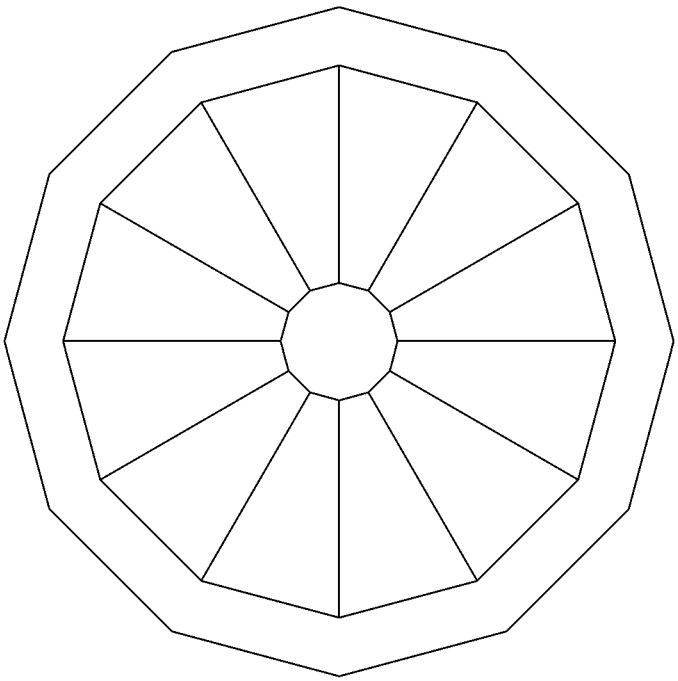

As illustrated in FIGS. 1 to 3, the shoe 101 according to the first embodiment of the present invention includes a first outsole 300, a second outsole 400, and a midsole 500.

The first outsole 300 includes a bottom portion 350 contacting the ground, and a plurality of first protruding portions 310 each in a dome shape protruding upward from the bottom portion 350. For example, the dome shape of the first protruding portion 310 may be a hollow hemispherical shape. The bottom portion 350 and the plurality of first protruding portions 310 may be unitarily formed. In such a case, each of the plurality of first protruding portions 310 is formed in a hollow hemispherical shape of which a surface facing the ground is open. That is, a bottom surface of the shoe 101 according to the first embodiment of the present invention is formed with the bottom portion 350 which is flat, and hemispherical depressions defined by the plurality of first protruding portions 310.

In addition, in the first embodiment of the present invention, a tread may be formed at the bottom portion 350 of the first outsole 300 to improve a grip force with the ground, as necessary.

The second outsole 400 includes a support portion 450 disposed above the bottom portion of the first outsole 300, and a plurality of second protruding portions 410 each in a dome shape protruding downward from the support portion 450. Protruding end portions of the plurality of second protruding portions 410 are bonded to protruding end portions of the plurality of first protruding portions 310, respectively. For example, the dome shape of the second protruding portion 410 may also be a hollow hemispherical shape. In addition, the support portion 450 and the second protruding portion 410 may be unitarily formed. In such a case, the support portion 450 opposes the wearer's sole.

As such, the hollow hemispherical shape of the first protruding portion 310 and the second protruding portion 410 is a structure which is physically effective in terms of shock absorbency and restoration. For example, balls, which are used in every ball game, may absorb shocks most quickly from any angle and return to their original shape most efficiently. However, if the ball is not a circle but a polyhedron, edges that connect the faces will be firstly worn out, and the recovered shape will not be made uniformly depending on the angle of faces and the angle of collision.

Accordingly, when the shoe sole is made into a spherical structure, both shock absorbency and resilient elasticity may be improved effectively. However, if the shoe sole is made into a complete spherical structure, the contact area with the ground is inevitably reduced, so that the grip force of the shoe is reduced.

However, according to the first embodiment of the present invention, the first outsole 300 and the second outsole 400 each have a hemispherical structure obtained by cutting a spherical structure in half, and the first outsole 300 and the second outsole 400 are bonded to each other up and down so that cut surfaces of these hemispherical structures face opposite directions from each other.

Accordingly, the shoe 101 according to the first embodiment of the present invention may effectively improve both the shock absorbency and the resilient elasticity and may also sufficiently secure the contact area with the ground.

As such, according to the first embodiment of the present invention, since a wide surface of the hemispherical first protruding portion 310 of the first outsole 300 faces the ground, and a wide surface of the hemispherical second protruding portion 410 of the second outsole 400 faces the wearer's sole, not only the wearer's sole is stably supported, but also the grip force with the ground is improved. However, in such a structure, an area in which the first protruding portion 310 and the second protruding portion 410, which are hemispherical, are bonded to each other becomes relatively small. Accordingly, the first protruding portion 310 and the second protruding portion 410 that are bonded to each other by using a general adhesive may not, upon rough movement, withstand and be detached from each other.

Accordingly, in the first embodiment of the present invention, the first protruding portion 310 and the second protruding portion 410 may be bonded to each other in a high frequency bonding method.

The basic principle of the high frequency bonding method is dielectric heating of the material to be bonded. When two materials, to be bonded to each other, placed between an electrode and a surface plate, are pressed by a high frequency mechanical press, while simultaneously heating the materials with vibration by high frequency to the melting point of the materials, the materials melt together and are strongly welded. Such a high frequency bonding method heats up quickly within a few seconds, thereby minimizing material loss while strongly welding.

As such, in a case where the first protruding portion 310 of the first outsole 300 and the second protruding portion 410 of the second outsole 400 are bonded to each other by using a high frequency bonding method, they may withstand the lateral force resulting from shocks and sudden turning movement up to three to four times the wearer's weight.

However, the above-described high frequency bonding method is not suitable for thermosetting materials. Accordingly, in the first embodiment of the present invention, materials based on thermoplastic polyurethane (TPU) or thermoplastic rubber (TPR) may be used for the first outsole 300 and the second outsole 400. In particular, thermoplastic vulcanizate (TPV) may be used for the first outsole 300 and the second outsole 400.

Thermoplastic vulcanizate (TPV) is a thermoplastic elastomer (TPE)-based polymer, but it has properties close to ethylene propylene rubber with both the properties of vulcanized rubber and the processing properties of thermoplastic resins. That is, thermoplastic vulcanizate (TPV) may not only well withstand compression and tension, but also have excellent durability and chemical resistance. In addition, thermoplastic vulcanizate (TPV) may be easily bonded by a high frequency bonding method.

In addition, in the first embodiment of the present invention, the plurality of first protruding portions 310 are spaced apart from each other with a predetermined empty space therebetween, and the plurality of second protruding portions 410 are spaced apart from each other with a predetermined empty space therebetween as well. In such a case, the predetermined empty space allows the plurality of first protruding portions 310 and the plurality of second protruding portions 410, each in a hemispherical shape, to spread laterally when they are crushed under pressure. Accordingly, a size of the empty space may be variously set according to a size and a degree of deformation of the first protruding portion 310 and the second protruding portion 410.

In addition, in the first embodiment of the present invention, edges of the bottom portion 350 of the first outsole 300 and the support portion 450 of the second outsole 400 are spaced apart from each other so that side surfaces of the plurality of first protruding portions 310 and the plurality of second protruding portions 410 are exposed to the outside.

Forming the first outsole 300 and the second outsole 400 in the above described manner may not only greatly reduce the overall weight of the shoe 101, but also prevent water from pooling between the first outsole 300 and the second outsole 400. That is, the first outsole 300 and the second outsole 400 according to the first embodiment of the present invention may be more usefully applied to shoes such as aqua shoes that are frequently submerged in water.

The midsole 500 is provided on the second outsole 400 and is coupled with a front-end portion and a back-end portion of the first outsole 300 and is coupled with an intermediate portion of the second outsole 500.

By such a configuration, the shoe 101 according to the first embodiment of the present invention may not only improve the shock absorbency, the resilient elasticity and the grip force, but also be light-weighted as well.

In addition, according to the first embodiment of the present invention, the shoe 101 may effectively prevent the wearer's ankle from being sprained.

In addition, according to the first embodiment of the present invention, by producing two injection products, i.e., the first outsole 300 and the second outsole 400, in a single mold, and disposing the midsole 500 thereon, the lower structure of the shoe 101 may be completed only with two molds, and thus the productivity may be greatly improved.

Hereinafter, modifications of the first embodiment of the present invention will be described with reference to FIGS. 4 to 9.

As illustrated in FIGS. 4 to 7, each of the first protruding portion 310 and the second protruding portion 410 may be formed in a dome shape in which a bottom view thereof is any one of an oval and a polygon with 12 or more sides.

In addition, the bottom view of the dome shape of the first protruding portion 310 and the second protruding portion 410 may be a combination of two or more shapes of a circle, an oval, and a polygon with 12 or more sides.

Figure 8:
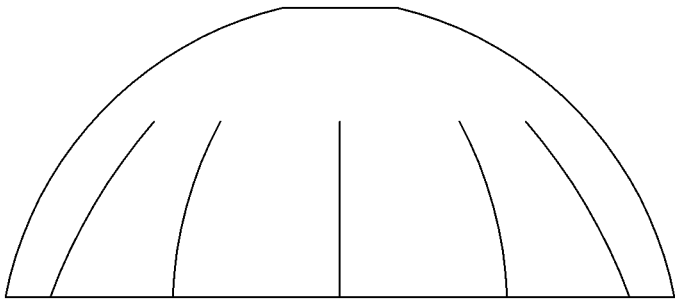
Figure 9:
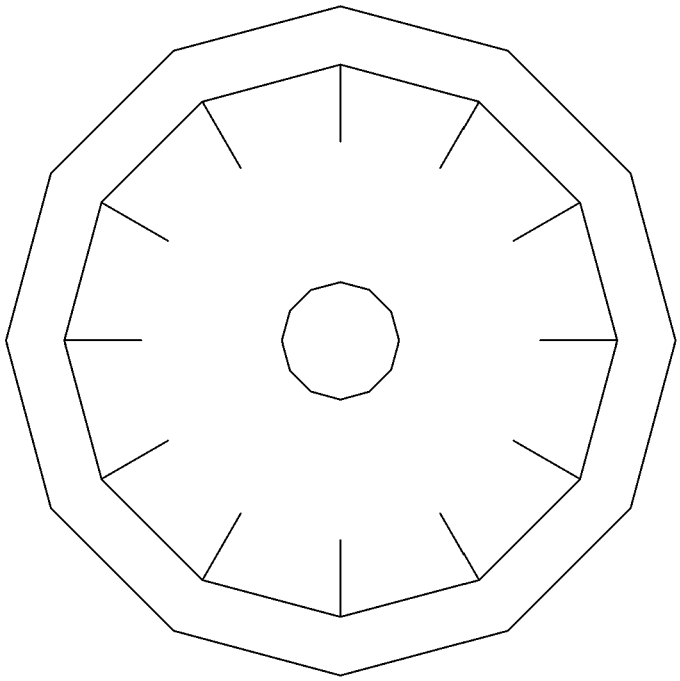

In addition, as illustrated in FIGS. 8 and 9, the dome shape of the first protruding portion 310 and the second protruding portion 410 may include a lower portion in a shape of a polygon with 12 or more sides and an upper portion in a hemispherical shape.

As such, the same effects as those of the first embodiment may be expected not only when the first protruding portion 310 and the second protruding portion 410 are each in a hollow hemispherical shape, but also when they are each in a shape similar to a hemispherical shape.

Hereinafter, a shoe 102 according to the second embodiment of the present invention will be described with reference to FIGS. 10 to 12.

Figure 10:
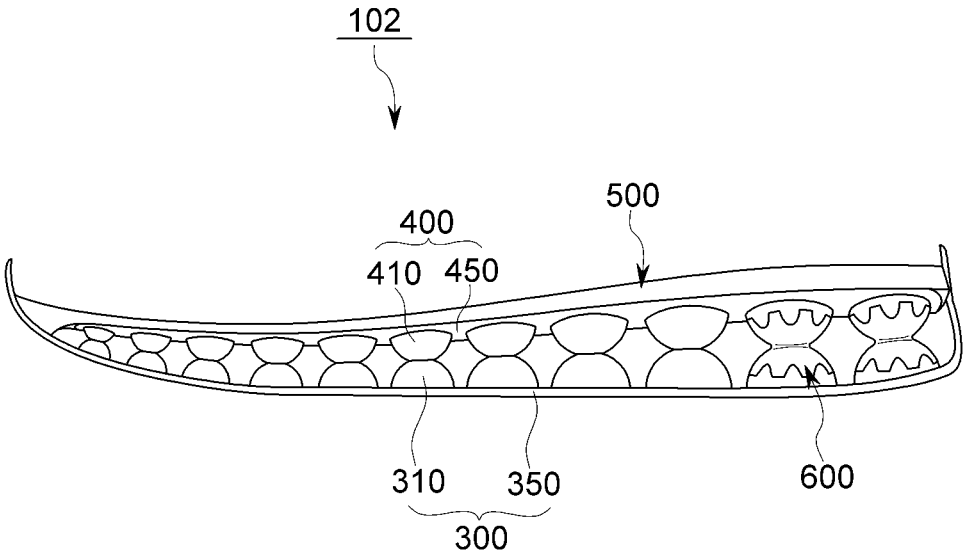
FIG. 10 is a front view illustrating an outsole and a midsole of a shoe according to the second embodiment of the present invention.
Figure 11:
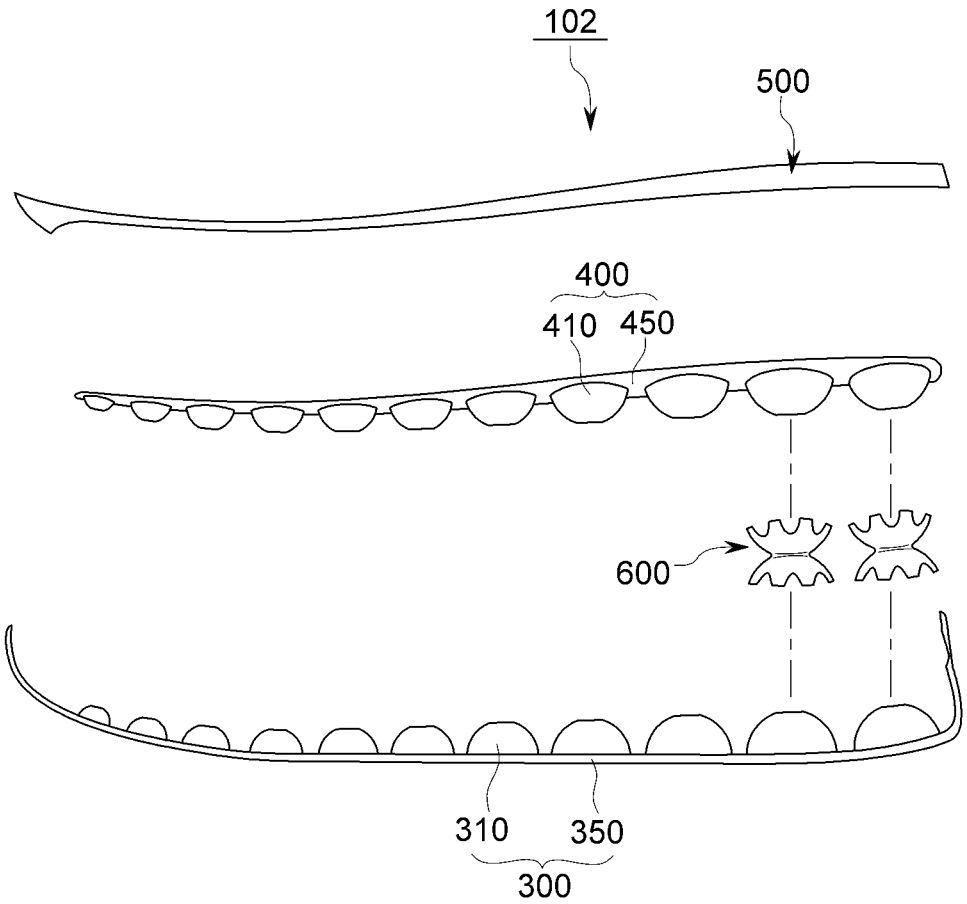
FIG. 11 is an exploded view illustrating the outsole and the midsole of a shoe of FIG. 10.
Figure 12:
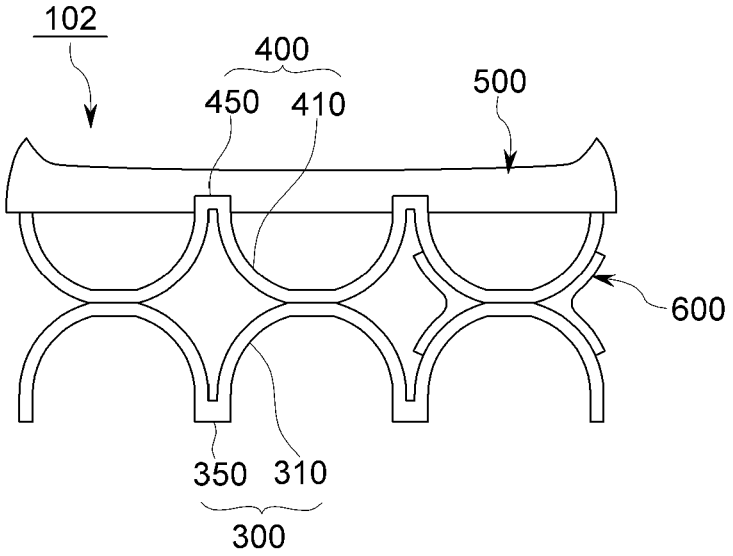
FIG. 12 is a cross-sectional view illustrating the outsole and the midsole of the shoe of FIG. 10.

As illustrated in FIGS. 10 to 12, the shoe 102 according to the second embodiment of the present invention further includes a reinforcing member 600 provided at one or more positions between the plurality of first protruding portions 310 of the first outsole 300 and the plurality of second protruding portions 400 of the second outsole 400. That is, the reinforcing member 600 is not invariably interposed between all respective ones of the plurality of first protruding portions 310 and the plurality of second protruding portions 410 but may be interposed at an optional position as necessary.

In detail, the reinforcing member 600 may be formed surrounding part of the first protruding portion 310 and the second protruding portion 410 and have a hole therethrough to contact the first protruding portion 310 and the second protruding portion 410.

In addition, the reinforcing member 600 may be made of a material having a hardness different from that of the plurality of first protruding portions 310 and the plurality of second protruding portions 410. In particular, the reinforcing member 600 may have a hardness higher than that of the plurality of first protruding portions 310 and the plurality of second protruding portions 410.

For example, the reinforcing member 600 may be disposed at a portion, between the first protruding portion 310 and the second protruding portion 410, corresponding to the wearer's heel. Since the strongest impact is applied to the portion corresponding to the wearer's heel, the reinforcing member 600 may be used to compensate for this in the second embodiment of the present invention.

In addition, the reinforcing member 600 may be disposed at a portion, between the first protruding portion 310 and the second protruding portion 410, corresponding to an inner central portion of the wearer's foot to suppress the inward turning of the foot that may occur so as to distribute the load received by the ankle when walking or running. When walking or exercising for a long time with such pronation, it easily causes fatigue and is a major cause of ankle or knee injuries. According to the second embodiment of the present invention, such pronation may be suppressed.

With such a configuration, the shoe 102 according to the second embodiment of the present invention may not only improve the shock absorbency, the resilient elasticity, and the grip force, but also be light-weighted as well.

In addition, according to the second embodiment of the present invention, the shoe 102 may prevent the wearer's ankle from being sprained more effectively.

In addition, by disposing the reinforcing member 600 in a selective position as necessary, it is possible to reinforce portions to which a strong impact is applied and to suppress pronation.

Hereinafter, a shoe 103 according to the third embodiment of the present invention will be described with reference to FIGS. 13 to 15.

Figure 13:
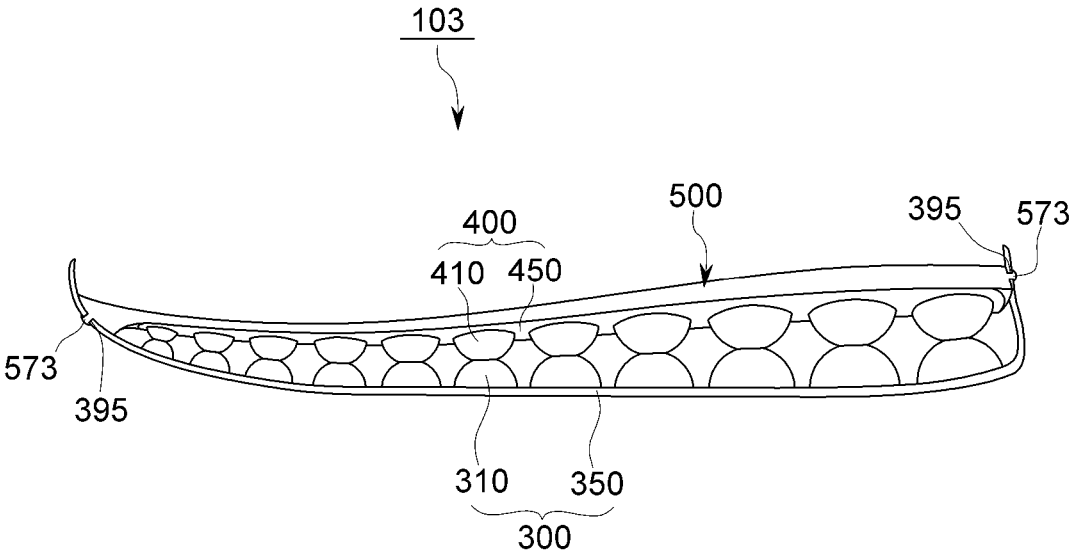
FIG. 13 is a front view illustrating an outsole and a midsole of a shoe according to the third embodiment of the present invention.
Figure 14:
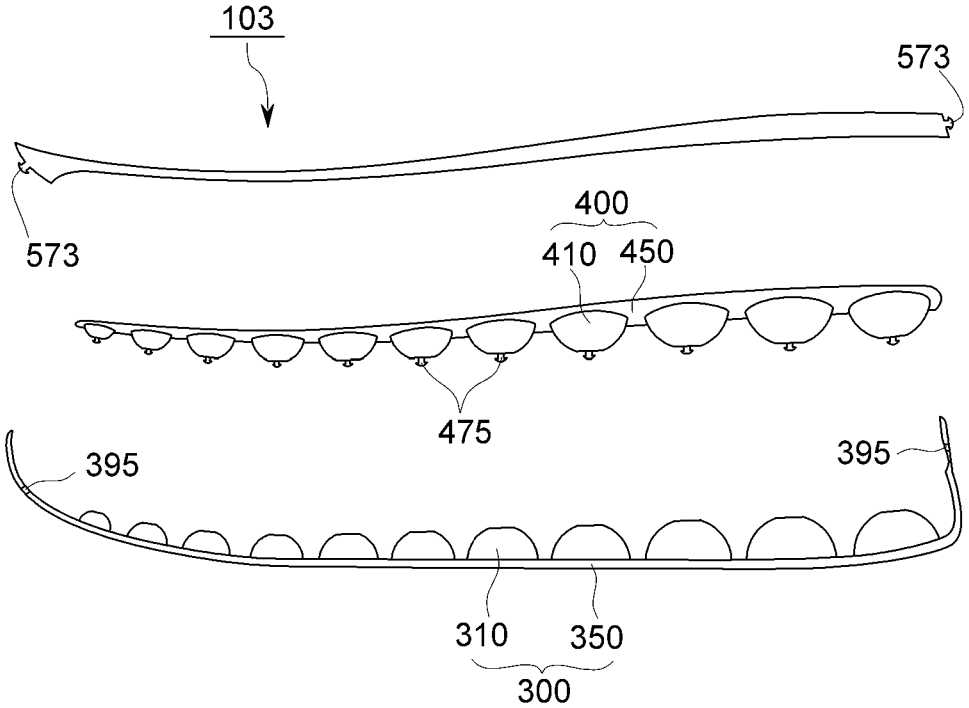
FIG. 14 is an exploded view illustrating the outsole and the midsole of FIG. 13.
Figure 15:
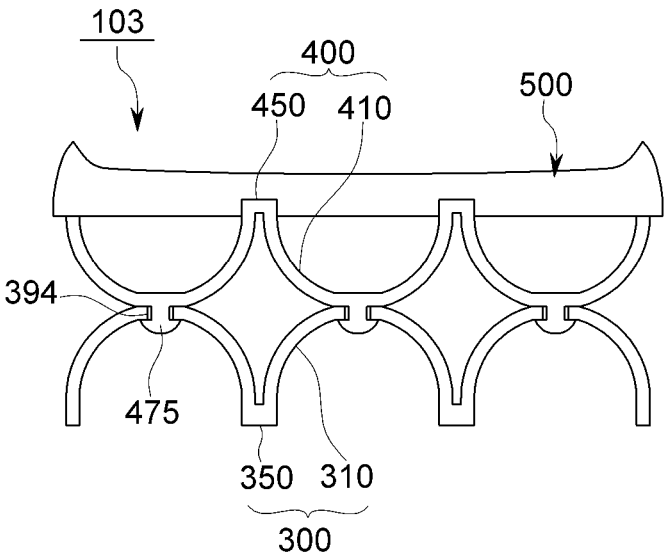
FIG. 15 is a cross-sectional view illustrating the outsole and the midsole of the shoe of FIG. 13.

As illustrated in FIGS. 13 to 15, in the shoe 103 according to the third embodiment of the present invention, the first protruding portion 310 of the first outsole 300 and the second protruding portion 410 of the second outsole 400 may be coupled to each other through an outsole-coupling locking projection 475 and an outsole-coupling locking hole 394.

Specifically, the outsole-coupling locking projection 475 may be formed extending from the second protruding portion 410, and the outsole-coupling locking hole 394 may be defined in the first protruding portion 310. The first outsole 300 and the second outsole 400 may be coupled to each other by inserting the outsole-coupling locking projection 475 into the outsole-coupling locking hole 394.

In particular, by forming the outsole-coupling locking projection 475 in the second protruding portion 410 and defining the outsole-coupling locking hole 394 in the first protruding portion 310, it is possible to prevent water from being accumulated in the first outsole 300 and the second outsole 400, and even when the shoe 103 is submerged in water, water may be smoothly drained.

In addition, the midsole 500 and the first outsole 300 may also be coupled to each other through a midsole-coupling locking projection 573 and a midsole-coupling locking hole 395.

Specifically, the midsole-coupling locking projection 573 may be formed extending from any one of the midsole 500 and the first outsole 300, and the midsole-coupling locking hole 395 may be defined in the other of the midsole 500 and the first outsole 300. The midsole 500 and the first outsole 300 may be coupled to each other by inserting the midsole-coupling locking projection 573 into the midsole-coupling locking hole 395.

In an embodiment, the midsole 500 and the second outsole 400 may be attached to each other with a general adhesive.

As such, by allowing the first outsole 300 to be separated from the second outsole 400 and the midsole 500, the first outsole 300 which contacts the ground and wears out, thus having relatively the shortest life, may be easily replaced to repair the shoe.

With such a configuration, the shoe 103 according to the third embodiment of the present invention may not only improve the shock absorbency, the resilient elasticity, and the grip force, but also be light-weighted as well.

In addition, according to the third embodiment of the present invention, the first outsole 300 that is severely worn out may be replaced, thereby improving the life of the shoe.

Figure 16:
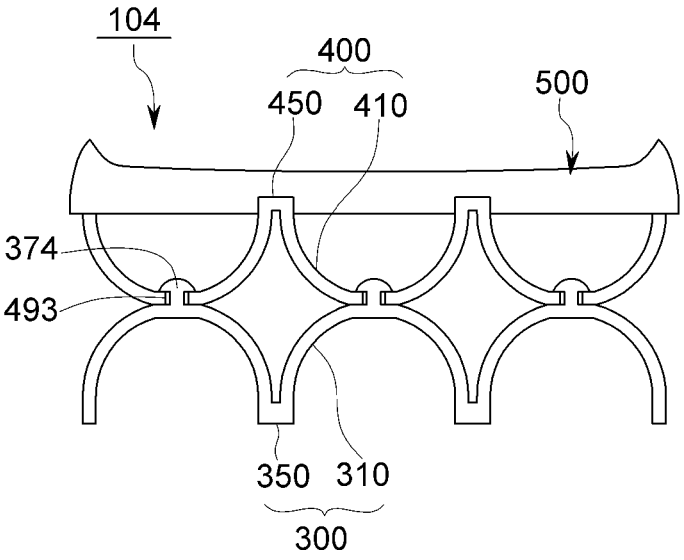
FIG. 16 is a cross-sectional view illustrating an outsole and a midsole of a shoe according to the fourth embodiment of the present invention.

FIG. 16 shows a shoe 104 according to the fourth embodiment of the invention. As illustrated in FIG. 16, an outsole-coupling locking projection 374 may be formed extending from the first protruding portion 310, and an outsole-coupling locking hole 493 may be defined in the second protruding portion 410.

Hereinafter, the fifth embodiment of the present invention will be described with reference to FIGS. 17 and 18.

Figure 17:
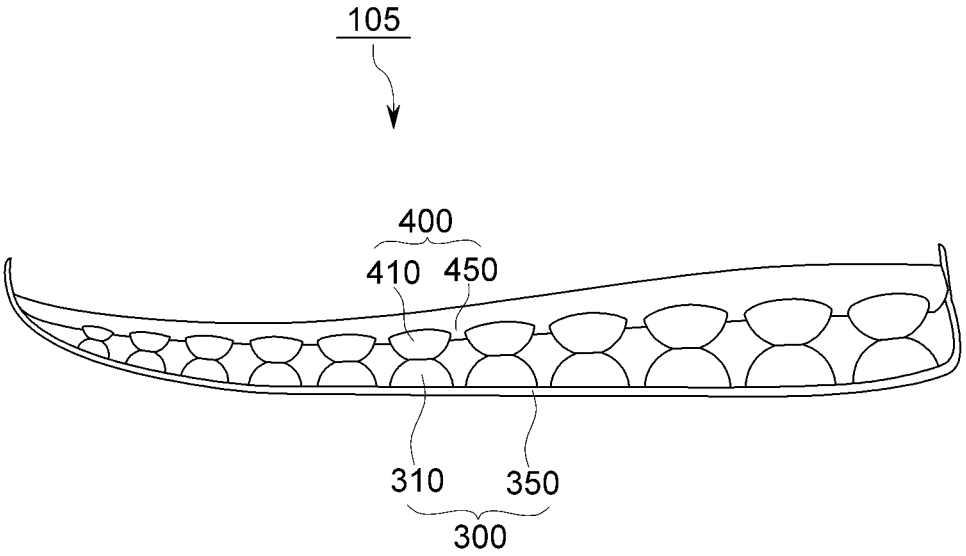
FIG. 17 is a front view illustrating an outsole of a shoe according to the fifth embodiment of the present invention.
Figure 18:
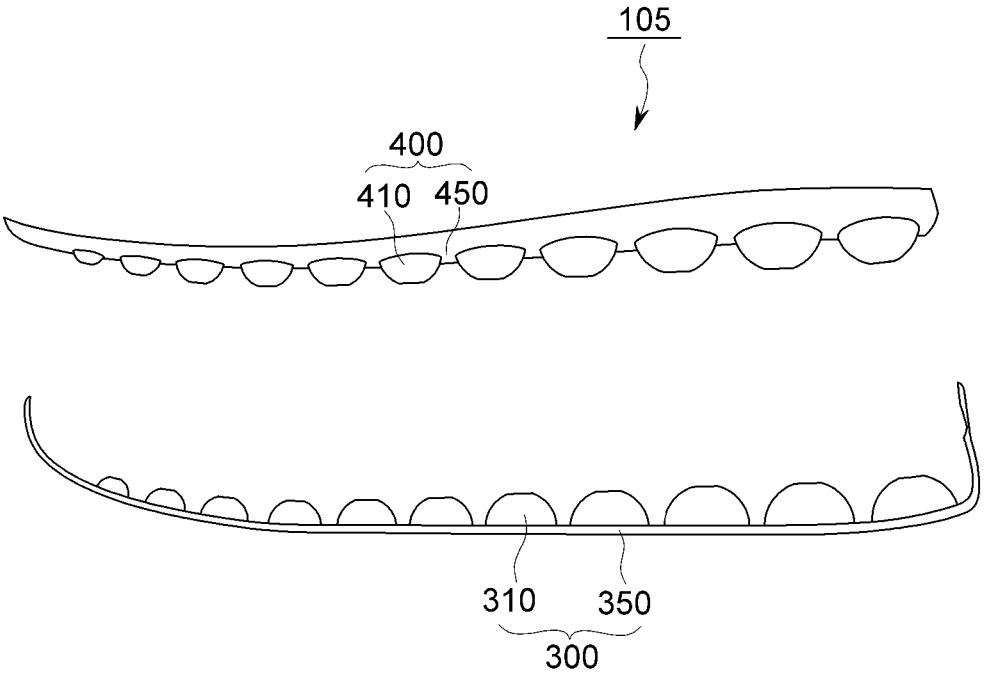
FIG. 18 is an exploded view illustrating the outsole of FIG. 17.

As illustrated in FIGS. 17 and 18, in the shoe 105 according to the fifth embodiment of the present invention, the midsole 500 in the first embodiment is omitted, and the second outsole 400 serves the function of the midsole 500.

In addition, since the midsole 500 is omitted in the fifth embodiment of the present invention, an edge of the bottom portion 350 of the first outsole 300 and an edge of the support portion 450 of the second outsole 400 are partially or entirely bonded to each other. For example, a front-end portion and a back-end portion of the bottom portion 350 of the first outsole 300 may be bonded to a front-end portion and a back-end portion of the support portion 450 of the second outsole 400, respectively.

With such a configuration, the shoe 105 according to the fifth embodiment of the present invention may improve the shock absorbency, the resilient elasticity, and the grip force while having a simpler structure.

In addition, the fifth embodiment of the present invention may be implemented in combination with the second to fourth embodiments. That is, the midsole 500 may also be omitted in the second to fourth embodiments.

Hereinafter, effects of wearing shoes of an experimental example according to the present invention and a comparative example are compared with reference to FIG. 19 and FIG. 20.

Figure 19:
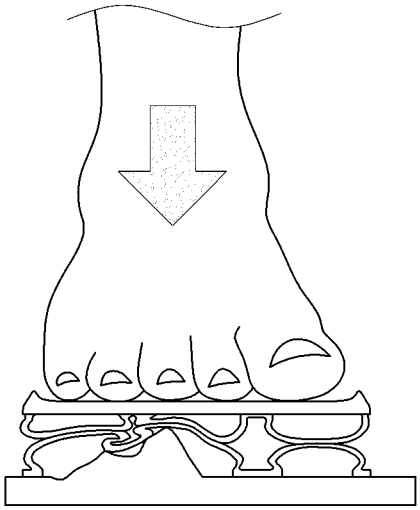
FIGS. 19 and 20 are views illustrating buffering effects of shoes by comparing an experimental example according to the present invention and a comparative example.

As illustrated in FIG. 19, in the experimental example according to the present invention, each of the plurality of first protruding portions and the plurality of second protruding portions serves the buffering function independently. Accordingly, in the case of the experimental example according to the present invention, even if the wearer of the shoes walks or jumps on irregular ground and steps on a stone, the turning of the ankle may be substantially minimized.

Figure 20:
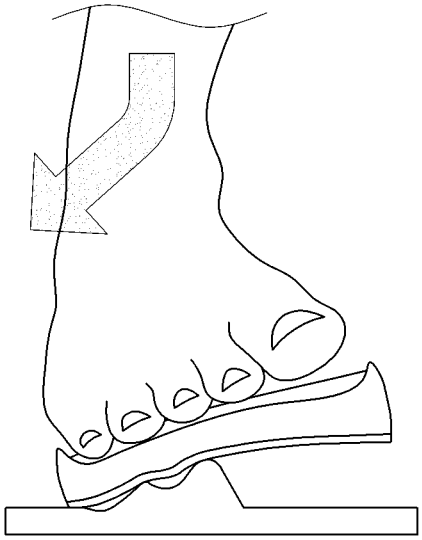
FIG. 20 PRIOR ART

On the other hand, as illustrated in FIG. 20, in the case of conventional shoes in a comparative example, when the wearer walks or runs on irregular ground and steps on a stone at inner part of the foot, the foot is inclined to the outside and the ankle is bent. In other words, there is a high risk that the wearer of the shoes will be injured when walking or running on irregular ground.

Although the embodiments of the present invention have been described above with reference to the accompanying drawings, those skilled in the art to which the present invention pertains may understand that the present invention may be implemented in other specific forms without changing the technical spirit or essential features.

Accordingly, the above-described embodiments are to be understood as illustrative and not restrictive in all respects, and the scope of the present invention is indicated by the appended claims. The meaning and scope of the claims and all changes or modifications derived from the equivalent concept should be interpreted as being included in the scope of the present invention.

INDUSTRIAL APPLICABILITY

Embodiments of the present invention may be used to provide shoes improved in terms of shock absorbency, resilient elasticity and grip force and light-weighted as well.

The invention claimed is:

1. A shoe, comprising:

a first outsole comprising a bottom portion which is configured to contact the ground, and a plurality of first protruding portions each of which has a dome shape and protrudes upward from the bottom portion; and a second outsole comprising a support portion disposed on or over the bottom portion, and a plurality of second protruding portions each of which has a dome shape and protrudes downward from the support portion, wherein each of the plurality of first protruding portions is in a hollow hemispherical shape formed to be open to the ground, such that an inner surface of each of the plurality of first protruding portions is exposed to the ground when the shoe is on the ground, wherein the plurality of first protruding portions are arranged to be adjacent to each other such that a lower end of one first protruding portion is connected to a lower end of another adjacent first protruding portion to form a portion of a contact area of the bottom portion that is to be in contact with the ground when the shoe is on the ground.

2. The shoe of claim 1, wherein a bottom view of the dome shape of each of the plurality of first protruding portions and the plurality of second protruding portions has one or more shapes of a circle, an oval, and a polygon with 12 or more sides.

3. The shoe of claim 1, wherein the dome shape of each of the plurality of first protruding portions and the plurality of second protruding portions includes a lower portion having a bottom view in a polygon shape with 12 or more sides and an upper portion in a hemispherical shape.

4. The shoe of claim 1, wherein edges of the bottom portion of the first outsole and the support portion of the second outsole are spaced apart from each other so that side surfaces of the plurality of first protruding portions and the plurality of second protruding portions are exposed to the outside.

5. The shoe of claim 1, wherein the plurality of first protruding portions are spaced apart from each other with a predetermined empty space therebetween, and wherein the plurality of second protruding portions are spaced apart from each other with a predetermined empty space therebetween.

6. The shoe of claim 1, further comprising a reinforcing member disposed at one or more positions between the plurality of first protruding portions and the plurality of second protruding portions.

7. The shoe of claim 6, wherein the reinforcing member is made of a material having a hardness different from those of the plurality of first protruding portions and the plurality of second protruding portions.

8. The shoe of claim 1, wherein an edge of the bottom portion of the first outsole and an edge of the support portion of the second outsole are partially or entirely bonded to each other.

9. The shoe of claim 1, further comprising a midsole disposed on the second outsole, coupled to a front-end portion and a back-end portion of the first outsole, and coupled to an intermediate portion of the second outsole.

10. The shoe of claim 9, further comprising:

a midsole-coupling locking projection extending from one of the midsole and the first outsole; and a midsole-coupling locking hole defined in the other of the midsole and the first outsole, wherein the midsole-coupling locking projection is inserted through the midsole-coupling locking hole.

11. The shoe of claim 1, wherein the plurality of first protruding portions and the plurality of second protruding portions are bonded to each other by a high frequency bonding.

12. The shoe of claim 11, wherein the plurality of first protruding portions and the plurality of second protruding portions are made of thermoplastic vulcanizate (TPV).

13. The shoe of claim 1, further comprising:

an outsole-coupling locking projection extending from one of the respective first protruding portion and the respective second protruding portion; and an outsole-coupling locking hole defined in the other of the respective first protruding portion and the respective second protruding portion, wherein the outsole-coupling locking projection is inserted through the outsole-coupling locking hole.

14. The shoe of claim 1, wherein a contact area of the bottom portion of the first sole that is to be in contact with the ground when the shoe is on the ground is smaller than an opening area of the plurality of first protruding portions opened toward the ground.

15. The shoe of claim 14, wherein the first outsole is connected to the second outsole only by coupling or bonding between protruding end portions of the plurality of first protruding portions and protruding end portions of the plurality of second protruding portions.

* * * * *